US007004379B2

(12) United States Patent
Holdsworth et al.

(10) Patent No.: US 7,004,379 B2
(45) Date of Patent: Feb. 28, 2006

(54) STACKABLE DISPLAY CONTAINER

(76) Inventors: James K. Holdsworth, 22 E. 51st St., Brant Beach, NJ (US) 08008; Ramon Morell, 22 E. 51st St., Brant Beach, NJ (US) 08008

( * ) Notice: Subject to any disclaimer, the term of this patent is extended or adjusted under 35 U.S.C. 154(b) by 0 days.

(21) Appl. No.: 10/480,688

(22) PCT Filed: Jun. 14, 2002

(86) PCT No.: PCT/US02/19025

§ 371 (c)(1),
(2), (4) Date: Dec. 12, 2003

(87) PCT Pub. No.: WO02/102672

PCT Pub. Date: Dec. 27, 2002

(65) Prior Publication Data

US 2004/0149815 A1 Aug. 5, 2004

(51) Int. Cl.
*B65D 5/20* (2006.01)
*B65D 21/032* (2006.01)

(52) U.S. Cl. ..... 229/164; 229/172; 229/178; 229/179; 229/915

(58) Field of Classification Search ..... 229/164, 229/172, 178, 179, 190, 915, 918, 919; 206/427, 206/431, 509, 511
See application file for complete search history.

(56) References Cited

U.S. PATENT DOCUMENTS 2,857,090 A 10/1958 Fallert
2,893,621 A 7/1959 Harnish et al.
3,202,337 A 8/1965 Cramer et al.
3,375,967 A 4/1968 Robinson
3,552,633 A 1/1971 Ketler
3,820,706 A 6/1974 Gibson et al.
3,883,067 A 5/1975 McGlynn et al.
3,940,053 A 2/1976 Putman et al.
4,056,223 A 11/1977 Williams
4,389,013 A 6/1983 Hall et al.

(Continued)

*Primary Examiner*—Gary E. Elkins
(74) *Attorney, Agent, or Firm*—Norman E. Lehrer

(57) ABSTRACT

A foldable container is formed from a single blank (12) of sheet material which has stacking shoulders (32, 34), reinforced corners (24, 26, 28, 30), side panels (16, 18) and display panels (20, 22). The container includes a bottom section (14) delimited by pairs of upright end panels and side panels (16, 18). Two of the side panels (16, 18) are foldably connected to peripheral segments of the bottom section, pre-glued (78) and cooperate with the latter to form an open top product-accommodating compartment. The top edges of each of the side panels include shoulders (32, 34) for supporting a container stacked thereon and positioning tabs (36, 38) that extend upwardly and fit into corresponding openings (40, 42) in the bottom (14) of the upper container. The lateral edge of each end panel and adjacent side panel has foldably connected thereto a corner-reinforcing member and create shopping accessibility from the front of the container. The reinforcing member includes a first section (50) connected to the end panel edge and being secured in partially overlying relation with the interior surface of the adjacent side panel. The reinforcing member also includes a second section (52) connected to the first section and secured thereto in at least a partial foldback overlying relation with the first section. A third section (58) is connected to the second section and is secured in partially overlying relation to the interior surface of the end panel. This configuration can be mirrored on the back panel providing two-sided shopability and is adaptable for three or four sided shopability.

6 Claims, 8 Drawing Sheets

U.S. PATENT DOCUMENTS

| | | | |
|---|---|---|---|
| 4,607,750 | A | 8/1986 | Valenti |
| 4,846,355 | A | 7/1989 | Price, Sr. et al. |
| 5,000,377 | A | 3/1991 | McClure |
| 5,294,044 | A | 3/1994 | Clark |
| 5,370,303 | A | 12/1994 | Fry |
| 5,413,276 | A | 5/1995 | Sheffer |
| 5,452,848 | A | 9/1995 | Mur Gimeno |
| 5,524,815 | A | 6/1996 | Sheffer |
| D380,639 | S | 7/1997 | Tisbo |
| 5,673,848 | A | 10/1997 | Garza |
| D386,931 | S | 12/1997 | Nemeth |
| 5,826,728 | A | 10/1998 | Sheffer |
| 5,839,650 | A | 11/1998 | Sheffer |
| 5,860,590 | A | 1/1999 | Blomfield et al. |
| 5,908,118 | A | 6/1999 | Tyler |
| 6,131,805 | A | 10/2000 | Gasior |
| 6,270,009 | B1 | 8/2001 | Heeren |
| 6,402,020 | B1 | 6/2002 | McClure |
| 6,568,588 | B1 | 5/2003 | Holdsworth et al. |

STACKABLE DISPLAY CONTAINER

TECHNICAL FIELD

The present invention is directed toward a stackable display container and, more particularly, to such a container formed from an integral flat piece of sheet material such as corrugated paperboard and which can be pre-glued and shipped knocked down flat, prior to assembly. Assembly, when desired, can then be accomplished without the use of glue or other adhesive. The invention can also be easily adapted for use on a variety of automatic and semi-automatic set up machines and case erectors while still maintaining the spirit of the invention.

BACKGROUND ART

Traditionally, products have been shipped in bulk from a manufacturer to a retailer in a variety of packaging display vehicles. The package display vehicles need to be attractive, stand up to the rigors of shipment, requiring minimal handling at the retail level and easy access to product. They also need to be cost effective.

The retail environment has changed drastically over the past few years. Retailers no longer want to cut cases for display or unpack goods on to shelves. Excess protective packaging such as increase board test, using double wall versus single wall, dividers, corner boards, slip sheets, layer pads or trays between layers of packages, add additional material, labor and freight costs to the manufacturer, retailer and the consumer. These cost variables can frequently be overlooked but can add to significant excess costs. The constant competitive pressure to drive costs down on the manufacturing and retail sides, while, at a minimum, maintaining profitability present challenges which the invention addresses.

Retailers demand packaging that facilitates high sales turnover within the allocated space in the shortest amount of time. They demand that the products be ready to shop once the pallet hits the retail floor and any perimeter protective packaging is removed. The next time they want to touch the packaging display vehicle is to recycle it.

These performance demands by retailers, reeked havoc on manufacturers who were tooled up with high speed, automatic packing equipment. Their production facilities were geared towards cases packing in standard shipping containers. Production floor space was utilized to its maximum. Along comes these new performance requirements, which necessitate modifying existing plant flow, acquiring new assembly space and labor or outsourcing the new packaging assembly requirements. Labor rates of many manufacturers are significantly higher than out-source assembly facilities. There is increased potential for incorrectly assembled packages in all locations due to the complex and diverse designs challenging these facilities.

To compound matters, many of the large retailers and warehouse clubs, are requiring special promotions, graphics, packages, sizes, counts etc. which make long production runs less feasible. Add to this, a constant pressure to reduce the costs to these retailers. Life cycles of a product package size, structure, quantity, graphics, merchandising, etc. become shorter, reducing the feasibility for long term packaging machinery expenditures. Companies now are forced to manufacture and market differently than ever before. They are further pressured by shareholders and banks to show incremental profit.

Many retailers are also merchandising bulk sales, which tend to weigh more than traditional products sold to local supermarkets. This presents certain problems that must be overcome avoiding a deleterious effect on the product that, in turn, might impair its marketability. Because of the weight and current designs of the superimposed stacked arrangement of packaging display vehicles, certain of the packages are subjected to substantial compressive forces. These may collapse or severely distort the lower packaging display vehicles sometimes nesting inside the container it was supposed to be superimposed and stacked on, resulting in sidewall deflection, tearing of adjoining interlocking legs and display panels, accidental exposure of product and in some cases, pallet loads collapsing. Other designs use display trays with smaller footprints and a smaller number of products per display in order to minimize twisting, torque and other disfigurement resulting from excessive stress when extra products are added. This results in an increased unit cost per package as the cost of the display and assembly is prorated over fewer pieces.

In normal warehousing or storage operations the stacked containers are palletized thereby enabling the entire stack to be readily moved about by lift trucks. Where, however, the lower containers of the stack are collapsed or severely distorted, the stability of the stack is seriously impaired thereby causing a serious hazard to personnel operating within the facility. Packaging used in high humidity environments places additional strength demands on the package.

Furthermore, in the packaging of certain products having substantial weight, difficulty is oftentimes encountered in properly stacking and palletizing the package display vehicle either because of bulging or distortion of the side or end walls thereof due to the weight of the product itself. Thus, the cost, time and effort required to package the product are significantly increased.

In order to attain the necessary strength and rigidity, of the packaging display vehicles used for such packaging, it has heretofore been necessary, in many instances, for them to be formed of heavy gauge costly material and/or to utilize special reinforcing inserts to be positioned within the packaging display vehicle. Numerous multiple 90 and 180 degree folds are required to lock reinforcement features in place adding additional labor costs, production displays and additional opportunities for repetitive stress injuries to occur. Oftentimes with products such as produce, frozen goods and meats, it has been necessary for certain portions of the container structures to be performed by the manufacturer and shipped and/or stored in such condition prior to being loaded with the product. In this latter situation storage of the empty preformed containers required an inordinate amount of space. Furthermore, because of certain design characteristics, numerous prior containers were not capable of accommodating a variety of products.

Many items can be easily damaged due to rough handling and inadequate protection, once the products appear on the retail floor. Most present efforts seem to focus on getting the product safely from their plant, to the retailers' distribution center and ultimately to the retail floor. In some cases, minimal effort seems to be placed on designing a package that will withstand the rigors of how it is actually shopped on the retail floor. When the front display panels bulge and tear, the product falls on the retail floor. Retailers must pay employees to individually reposition each product item on display in a manner that is both appealing to the customer and safe for the product. Some product becomes damaged goods, which result in preventable retailer aggravation, whose costs are deducted from invoices. Sometimes extra handling penalties for returned goods are charged as well. Other displays are re-taped, which may resolve the tearing and bulging issues but look terrible. This is especially evident on packages with high quality graphics, designed to promote brand quality and attract customers.

Conversely, other packaging display vehicles seem over packaged using heavier grades of corrugated single and double wall. This negatively impacts costs and can sometimes make it difficult to break down the empty packages for recycling. This adds to the retailers' costs and aggravation.

Many existing packaging display vehicles also require a shipping cover. This adds additional material packaging costs and labor to affix, remove and recycle the cover. Furthermore, some of these covers incur the extra cost burden of high quality graphics just to get their product from point a to point b safely.

Other existing packaging display vehicles utilize various forms of trays between each layer which are necessary reinforcement for bottoms which tend to sag as well as tie in the unit so the load is more stable. These trays are large, require labor to assemble or be machine glued and tend to block graphics and access to product within the primary packaging display vehicles below the tray. They are cumbersome to remove and recycle at the retail level as well. These trays are typically printed with graphics related to the primary package, which result in expensive print plates and cutting die costs being incurred.

Lead times are continuing to shrink. Many of the corrugated display vehicles are cumbersome and complicated to assemble. They also can take up considerable warehouse space due to their large pre-assembled footprints.

Containers have been proposed in the past to address some of the above problems. Such proposals are described, for example, in U.S. Pat. Nos. 5,413,276; 5,524,815; 5,826,728 and 5,839,650. None of these prior art containers, however, provides an adequate solution.

There is, therefore, a need in the art for a container with improved strength characteristics to withstand the collapsing or lateral deflection of vertical container walls which may result when forces are applied to such containers.

The is further a need for a container that is optimally adapted for pallet-type marketing, namely retail sale of products displayed in bulk in the containers in which they are shipped in bulk.

There is also a need for a container which resists inadvertent, horizontal displacement out of stacked relationship.

There is a further need for a container which is easy to manipulate and easy to assemble.

There is also a need for the container to have sufficient lateral rigidity to avoid collapse.

Advantageously, these objects and aspects should be achieved in a carton that is foldably erected from a one piece blank that is compactly arranged such that the carton blanks can be die cut from stock with minimal waste, can be pre-glued where necessary and still shipped substantially flat for later erection.

DISCLOSURE OF THE INVENTION

The present invention is designed to overcome the deficiencies of the prior art discussed above. It is an object of this invention to provide a foldable, joined or unjoined, inexpensive, yet sturdy, packaging display vehicle which is not beset with the aforenoted shortcomings associated with prior containers of this general type.

It is a further object of the invention to provide an optional pre-glued, foldable container which is formed from a single blank of inexpensive foldable sheet material having a simple configuration and capable of being produced by automatic high speed die cutting and gluing equipment.

It is still a further object to provide a foldable container which has an inordinately high top to bottom strength without requiring heavy gauge, expensive, high strength material and/or the utilization of corner inserts or the like.

It is still a further object of the invention to provide broad sidewall shoulders to support subsequent containers stacked above it, minimizing sag and the possibility of the container superimposed above it, nesting inside the container below it.

It is still a further object for tab and corresponding indexing slot locations to further improve container positioning, as additional containers are stacked on top of each other, the improved stability gained by these features improving product presentation and reducing product damage and extra handling at the retail level.

It is a still further object of the invention to provide a container, which provides graphic opportunities on the inside of the box, while printing the outside of the box in the same printing operation.

It is a still further object of the invention to provide options for one to four sided shopability.

It is still a further object of the invention to provide the opportunity to eliminate the use of trays between existing layers of product and still maintain the structural rigidity of the container.

It is a further object of the invention to provide an open-top and partially opened front panel (and optional back panel) which provides excellent product accessibility while simultaneously reducing in store handling and damaged goods.

It is a still further object of the invention to provide a container which, prior to use, may be stored or shipped in a completely unfolded or partially folded but collapsed condition.

In accordance with the illustrative embodiments, demonstrating features and advantages of the present invention, there is provided a foldable container formed from a single blank of sheet material which has reinforced corners and display panels. The container includes a bottom section delimited by pairs of upright end panels and side panels. Two of the side panels are foldably connected to peripheral segments of the bottom section, pre-glued and cooperate with the latter to form an open top product-accommodating compartment. The top edges of each of the side panels include shoulders for supporting a container stacked thereon and positioning tabs that extend upwardly and fit into corresponding openings in the bottom of the upper container. The lateral edge of each end panel and adjacent side panel has foldably connected thereto a corner-reinforcing member and create shopping accessibility from the front of the container. The reinforcing member includes a first section connected to the end panel edge and being secured in partially overlying relation with the interior surface of the adjacent side panel. The reinforcing member also includes a second section connected to the first section and secured thereto in at least a partial foldback overlying relation with the first section. A third section is connected to the second section and is secured in partially overlying relation to the interior surface of the end panel. This configuration can be mirrored on the back panel providing two-sided shopability.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

BEST MODE FOR CARRYING OUT THE INVENTION

Figure 1:
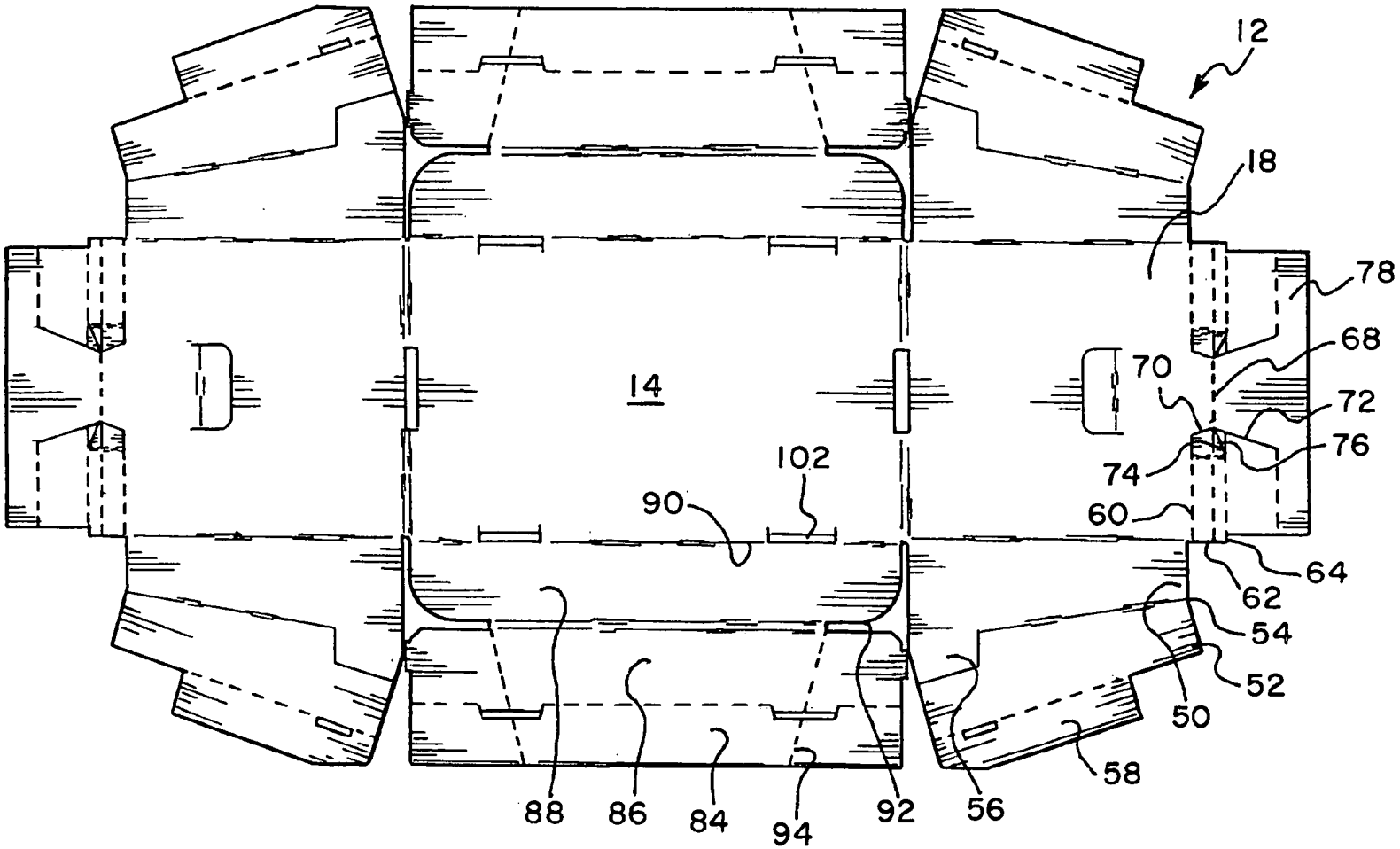
FIG. 1 is a top plan view of a die-cut blank used in forming the container of the present invention.
Figure 2:
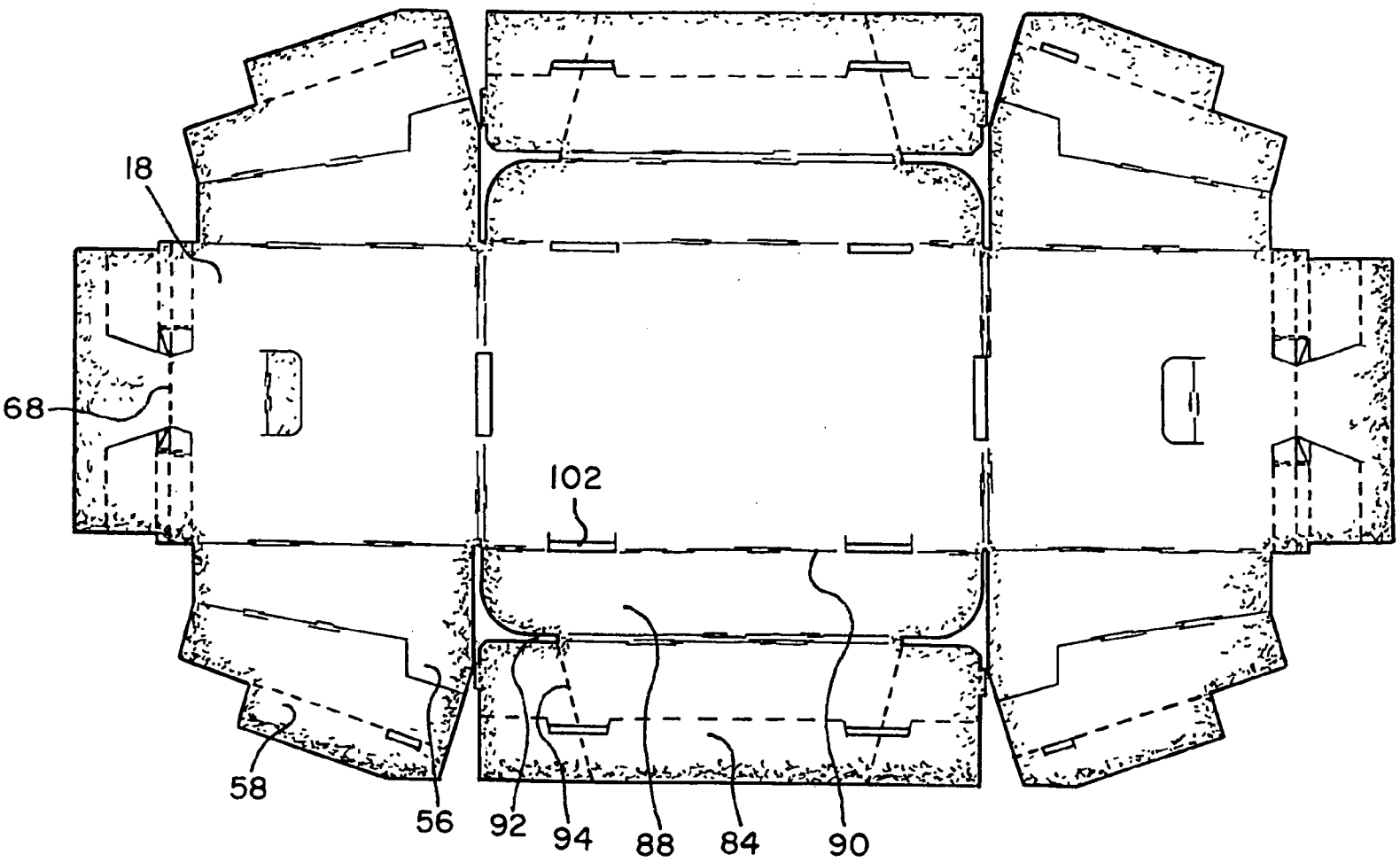
FIG. 2 is a bottom plan view of the blank shown in FIG. 1.
Figure 11:
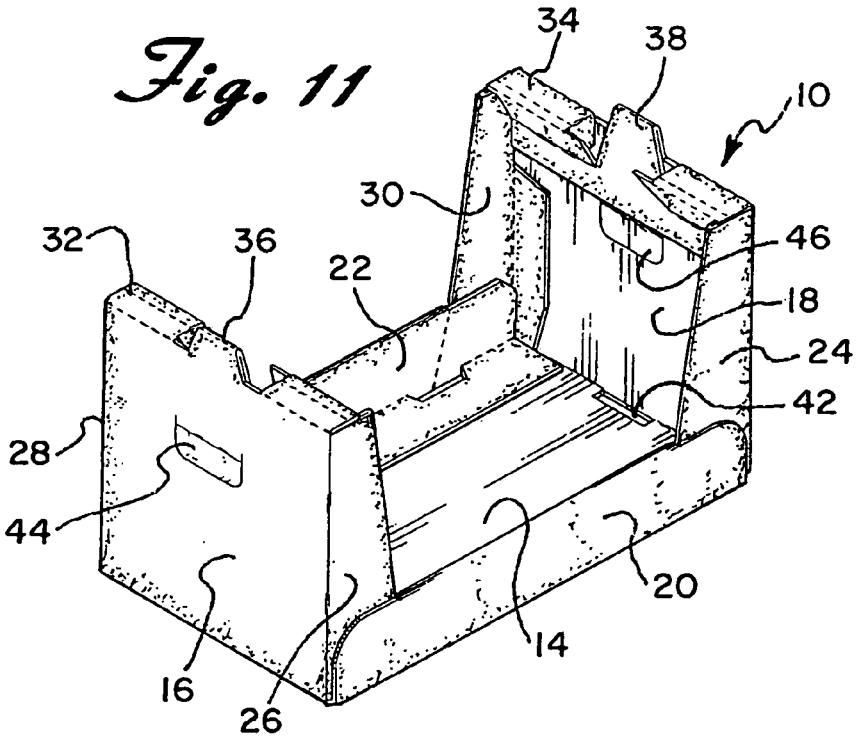
FIG. 11 is a perspective view of a fully assembled container.

Referring now to the drawings in detail wherein like reference numerals have been used throughout the various figures to designate like elements, there is shown in FIG. 11 a stackable display container constructed in accordance with the principles of the present invention and designated generally as 10. The container 10 is preferable constructed from a single sheet of corrugated cardboard or similar material which is cut and scored to form the single blank 12 shown in FIGS. 1 and 2. FIG. 1 shows the top or upper surface of the blank 12 while FIG. 2 show the bottom or lower surface.

Figure 13:
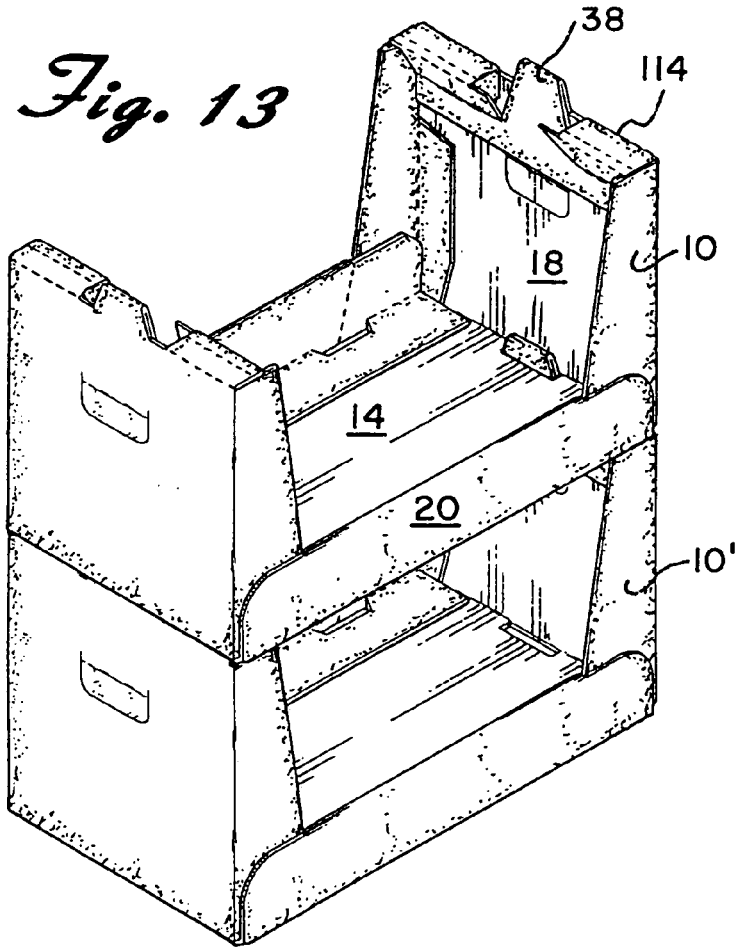
FIG. 13 is a perspective view showing two stacked containers.
Figure 12:
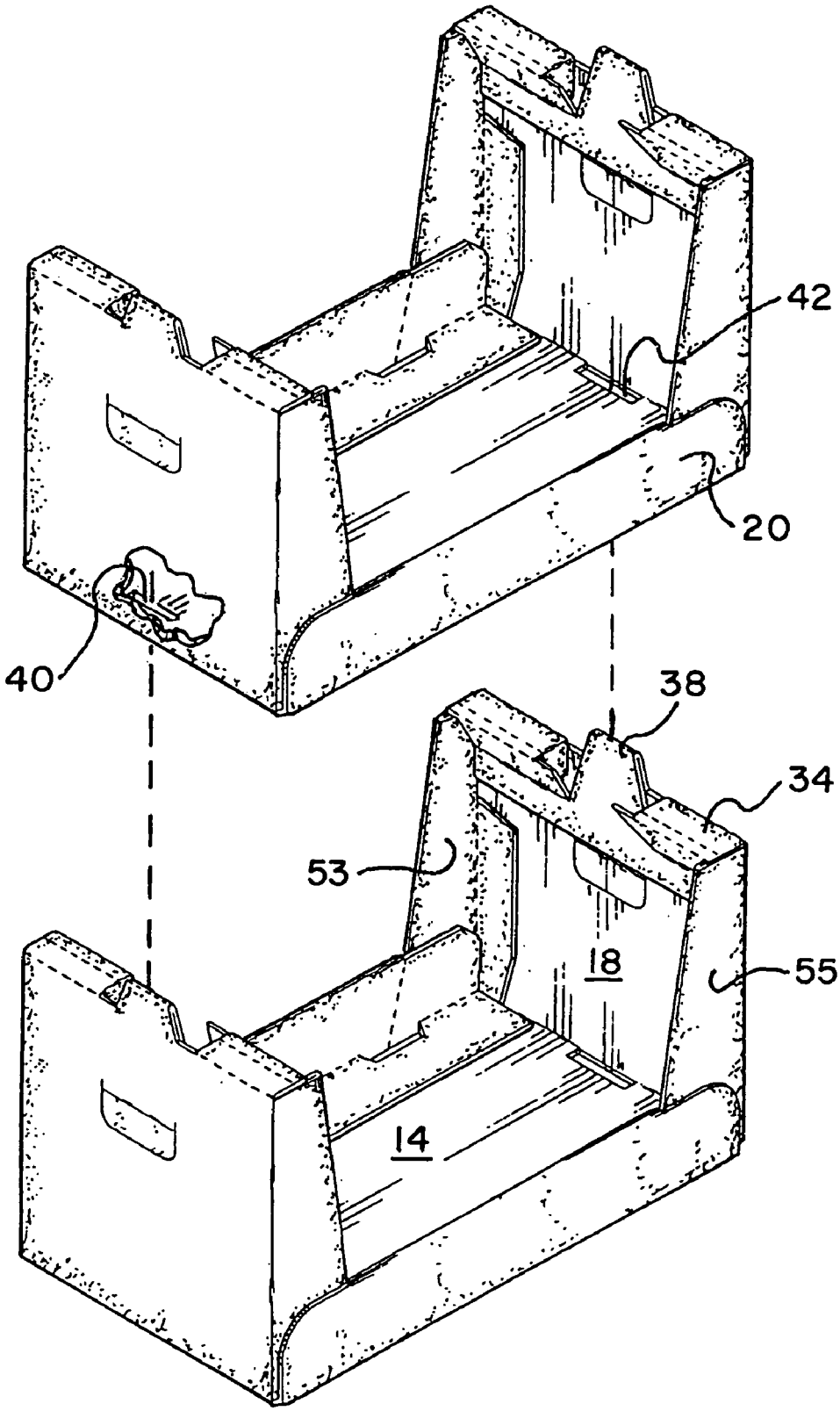
FIG. 12 is a perspective view of two containers and showing the manner in which they can be stacked one on top of the other.

Container 10 as shown best in FIGS. 11, 12 and 13 includes a substantially horizontal bottom wall 14 having a left edge, a right edge, a front edge and a rear edge. The container also includes, left and right side walls 16 and 18 that extend substantially vertically upwardly from the left and side edges and partial front and rear walls 20 and 22 that extend substantially vertically upwardly from the front and rear edges, respectively. The side walls 16 and 18 are joined to the partial front and rear walls 20 and 22 through corner posts or columns 24, 26, 28 and 30.

Each of the side walls 16 and 18 includes a substantially horizontally oriented shoulder 32 and 34 at the top thereof. As shown best in FIGS. 12 and 13, this allows containers of similar construction to be stacked, one or top of the other. FIGS. 12 and 13, for example, show container 10 being stacked on top of a similarly constructed container 10'.

In order to properly align one container on top of the other and prevent movement thereof, positioning tabs 36 and 38 extend vertically upwardly from the tops of the side walls 16 and 18, respectively. The positioning tabs 36 and 38 are adapted to be received in slotted openings 40 (See FIG. 12) and 42 formed in the bottom wall 14 of the container stacked on top thereof. That is, since all of the containers are constructed in essentially the same manner, each includes the pair of positioning tabs and each includes the slotted openings in the bottom wall that cooperate with the positioning tabs as best shown in FIGS. 12 and 13. For ease of carrying and maneuvering the container 10, conventional handles 44 and 46 are formed in the upper portions of the side walls 16 and 18.

Although the container 10 shown in all of the figures has a partial front and a partial rear wall, it should be understood that this is by way of example only. Having the partial front and rear walls leaves exposed openings at the front and rear thereof even when the containers are stacked on top of each other as shown in FIGS. 12 and 13. As a result, the containers can be used for merchandising goods contained therein from both the front and the back. This is, however, by way of example only. It should be readily understood that the majority of the features of the present invention could also be utilized with a container having a full back wall and wherein only the front has a partial wall. In addition, all four walls could be similarly constructed to be partial walls whereby goods could be merchandised from all four sides. Even further, and as will become clearly hereinafter, some of the inventive features of the invention could be utilized with full front and back walls.

The details of the manner in which the blank 12 shown in FIGS. 1 and 2 is manipulated and folded to form the container 10 will be described in detail below. However, before doing so, it should be readily apparent to those skilled in the art that the container 10 of the present invention, in the preferred embodiment shown, is symmetrical both left to right and front to back. That is, the left wall 16 including the corners 26 and 28 and the shoulder and positioning tab 36 and slotted opening 40 are identical to the right side wall 18 with its corners 24 and 30 and shoulder 34, positioning tab 38 and slot 42. Similarly, the partial front wall 20 is identical to the partial rear wall 22. Thus, in the following description, while only one portion of the container 10 will be described in detail, it should be understood that the other corresponding portions of the container are constructed in the identical manner and that the description applies equally thereto. For example, while only one corner post may be described in detail, it will be readily understood that the description thereof applies equally to each of the other three corners. Similarly, while only the partial front wall 20 may be described in detail and only one of the side walls, the partial rear wall 22 and the other side wall is constructed in the identical manner as the one described.

As pointed out above, the container 10 is formed from a single piece of corrugated cardboard or similar material which is die-cut and formed into a blank 12 as shown in FIGS. 1 and 2. The blanks 12 could be shipped to the product manufacturer who will fold the same to form the container 10 before putting packaged goods therein. Preferably, however, a limited number of folding and gluing steps are performed by the carton manufacturer before shipment. This can be done on high speed automatic folding and gluing machines after the blanks 12 are formed.

Figure 3:
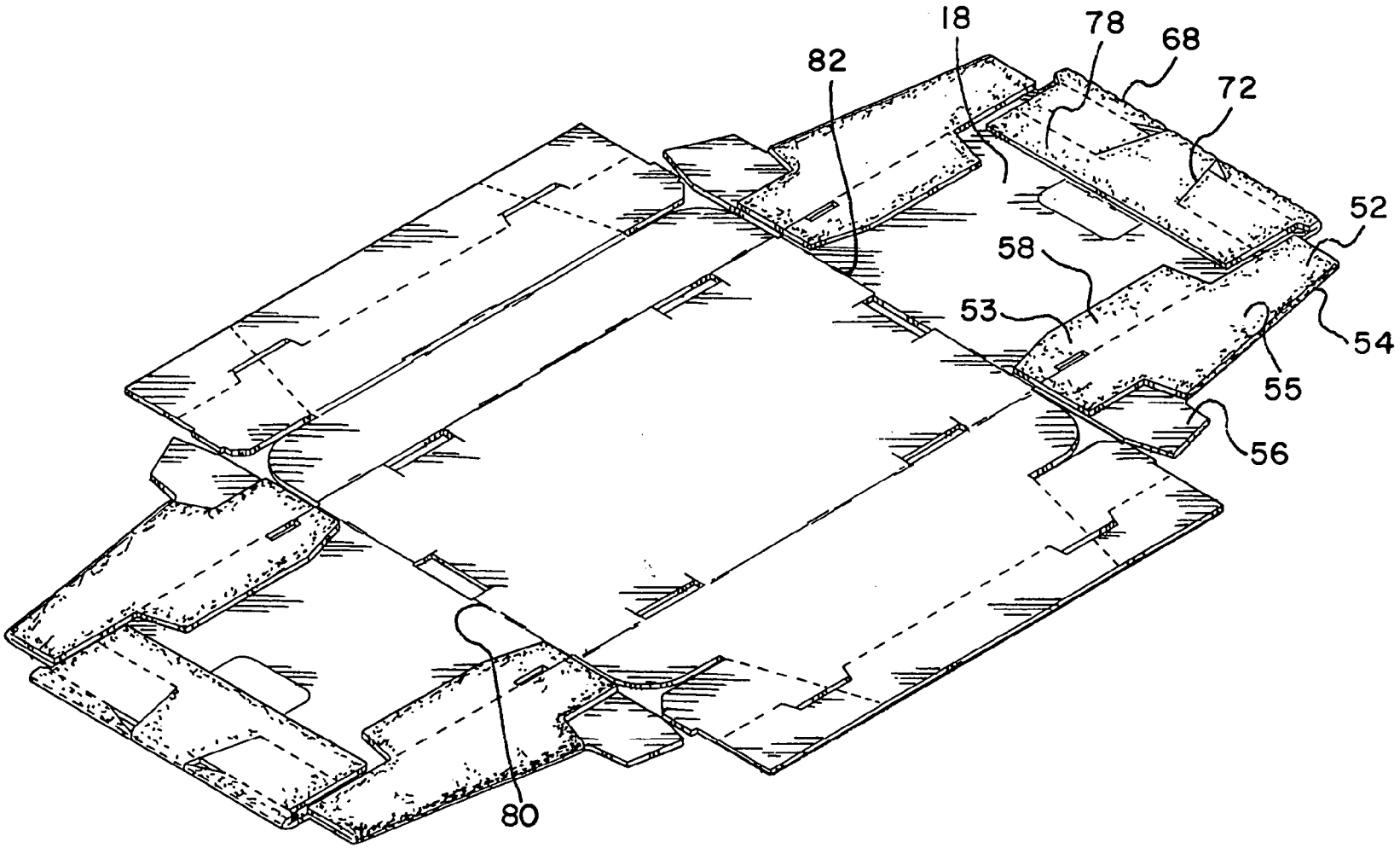
FIG. 3 is top perspective view of the blank shown in FIG. 1 with portions thereof folded over and glued.

FIG. 3 illustrates the folded and glued preform after the automatic folding and gluing steps and prior to shipment. More particularly, the multiple panels 50 and 52 that form the corner posts such as corner post 24 are folded over each other about the fold line 54 to form a corner comprised of two layers of sheet material. (See FIG. 1.) The fold line 54, however, extends from the top of the corner, i.e. the right side as shown in FIG. 1, approximately three-quarters of the way down the corner and is then cut to form a foot 56. Thus, when the panel 52 is folded over to overlay the panel 50, the foot 56 remains extending outward therefrom as shown in FIG. 3. When the panel 52 is folded over so as to overlie panel 50, the smaller panel 58 at the free end of the corner panels overlies the edge of the inner surface of the side wall 18 and is glued thereto to form a side corner wall 53 as shown in FIG. 3 and the main portion of panel 52 overlying panel 50 forms a front corner wall 55. As pointed out above, each of the other corners is formed in the identical manner.

The shoulder forming panels and positioning tabs described above are pre-cut and formed at the uppermost part of the panel forming the side walls such as side wall 18 as shown in FIG. 1. The shoulder and positioning tab forming panels include fold lines such as shown at 60, 62, 64, 66 and 68 and die-cut sections such as shown at 70, 72, 74 and 76. At the factory, the top end of the panel forming the side wall 18 is folded over along fold line 68 and the inner surface 78 of the panel is glued to the inner surface of the side wall 18 as shown in FIG. 3.

The formed panel shown in FIG. 3 is, therefore, ready for assembly into a container 10. Although certain folding and gluing steps have been performed, the pre-form shown in FIG. 3 still lies perfectly flat and, therefore, can be easily shipped for later assembly.

Figure 4:
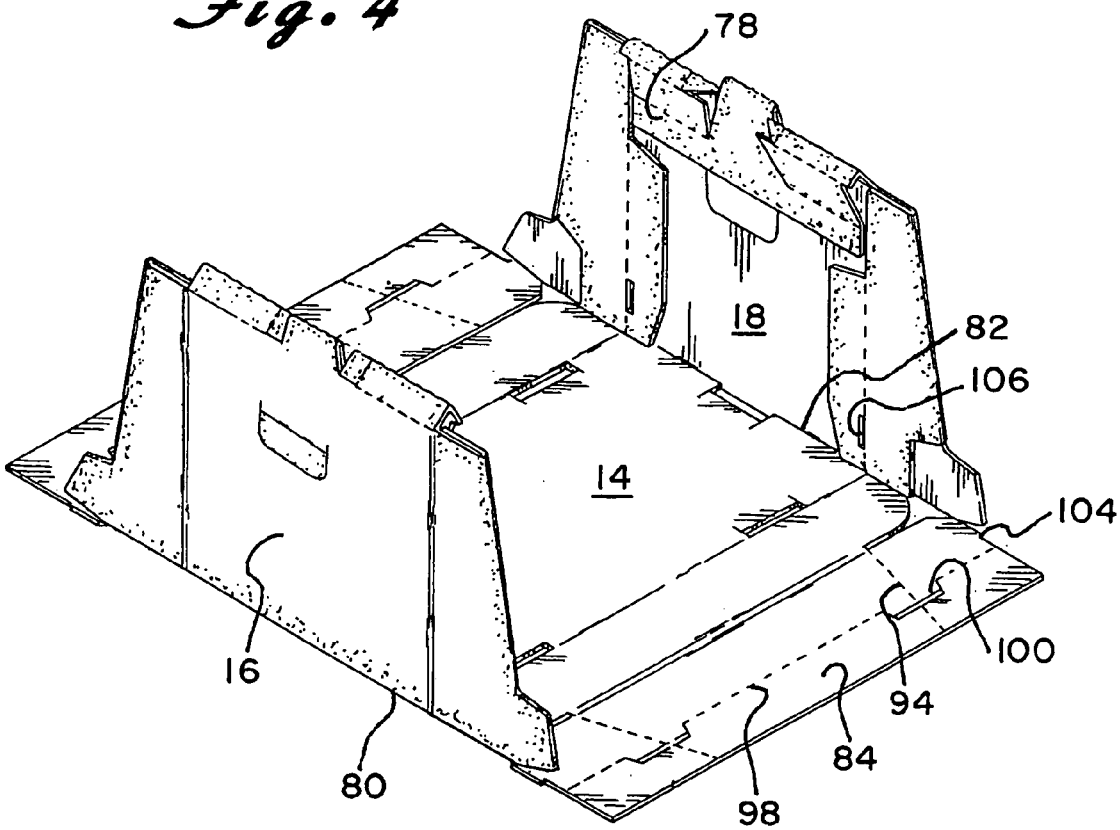
FIG. 4 is perspective view similar to FIG. 3 but showing the end walls folded to extend upwardly which is one of the first steps in erecting the container.
Figure 5:
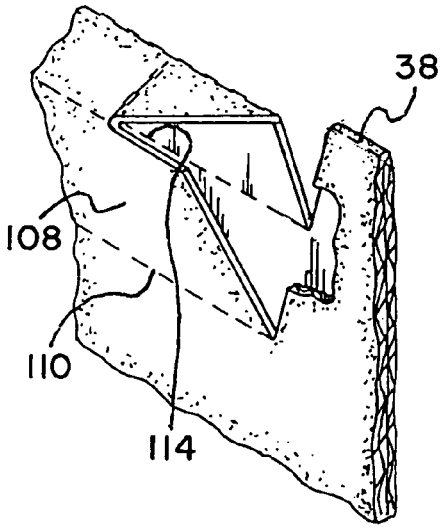
FIG. 5 is an enlarged view of a portion of the top of one of the end walls showing a first step in forming a shoulder thereon.
Figure 6:
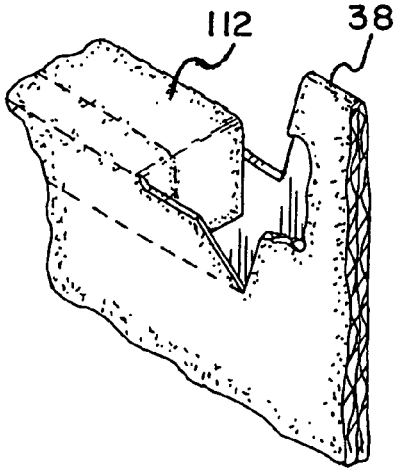
FIG. 6 is a view similar to FIG. 5 showing the final step in forming the shoulder.
Figure 7:
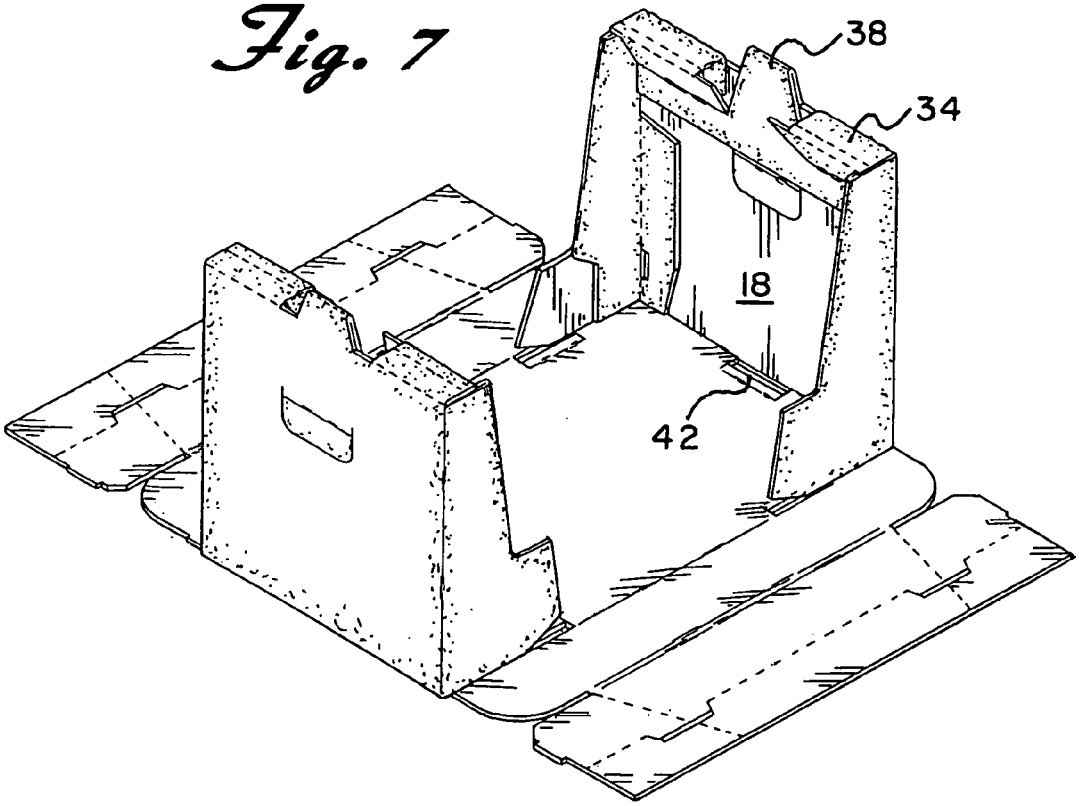
FIG. 7 is a perspective view similar to FIG. 4 showing a portion of the ends being folded inwardly to form a part of the corner columns and a part of the front and rear partial walls.

FIGS. 4–10 illustrate the sequential steps performed to erect the container 10. First, the two end walls 16 and 18 with the corners attached thereto are folded upwardly around the transverse fold lines 80 and 82 until they are substantially vertical as shown in FIG. 4. Thereafter, the corners are folded inwardly as shown in FIG. 7 so as to be perpendicular to the end or side wall 16 and 18. As can best be seen in FIG. 7, the corner column that is parallel and forms part of the front wall is two-ply with each ply extending entirely from the very top of the corner to the very bottom thereof with the lower portion of the panel 52 forming the inner ply extending all the way to the bottom wall 14. Each corner also includes the foot 56 which, as will be seen, forms part of the front (or rear) wall 20.

Figure 8:
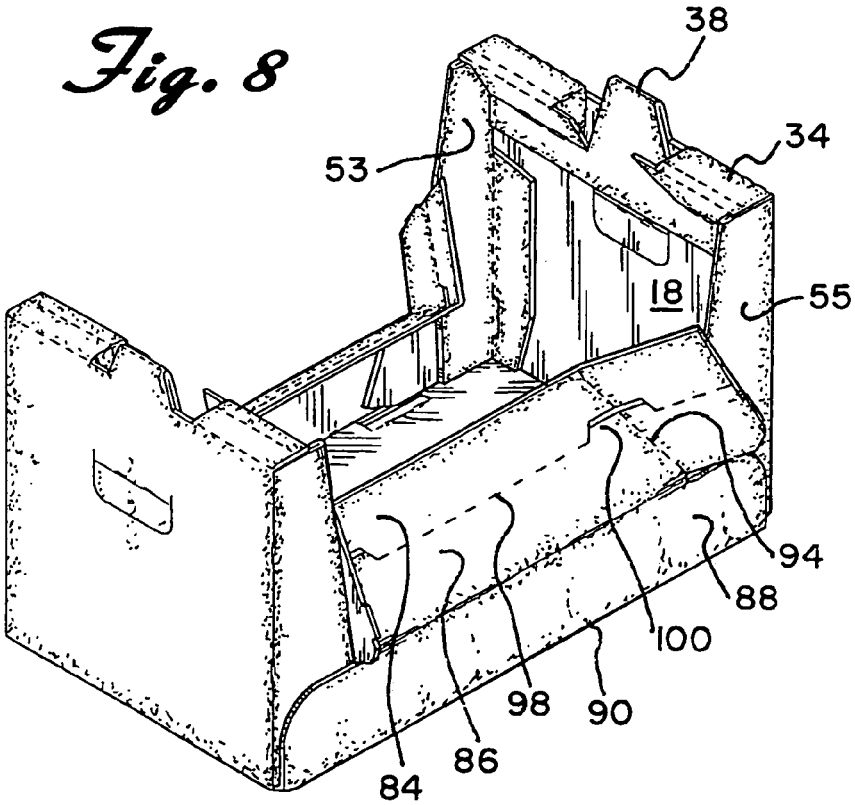
FIG. 8 is a perspective view similar to FIG. 7 showing further folding steps to further form the front and rear partial walls.

Referring now to FIG. 8, after the corners are folded in, the three panels 84, 86 and 88 are folded about the fold line 90 into a vertical direction so that the ends of the panel 88 which forms the partial front wall 20 lie against the forward face of the corners. The panels 84 and 86 are then folded inwardly over the feet 56. It should be noted that notches 92 are formed at the ends of the junction between panels 86 and 88 and angled fold or score lines 94 are formed which allow the ends of the panels 84 and 86 to flex upwardly as the panels 84 and 86 are moved inwardly toward the center of the container 10. This allows the ends of the panels 84 and 86 to more easily pass around the front corner walls 55 so as to be positioned therebehind.

Figure 9:
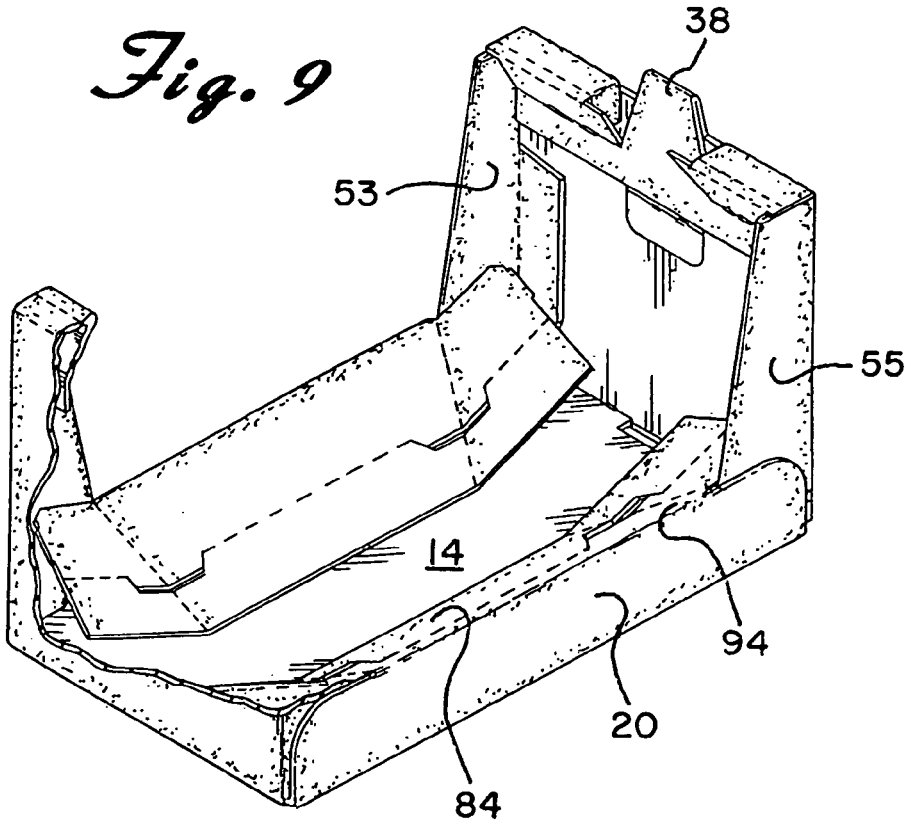
FIG. 9 is a perspective view similar to FIG. 8 but with portions broken away for clarity and showing the next steps in forming the front and rear partial walls.
Figure 10:
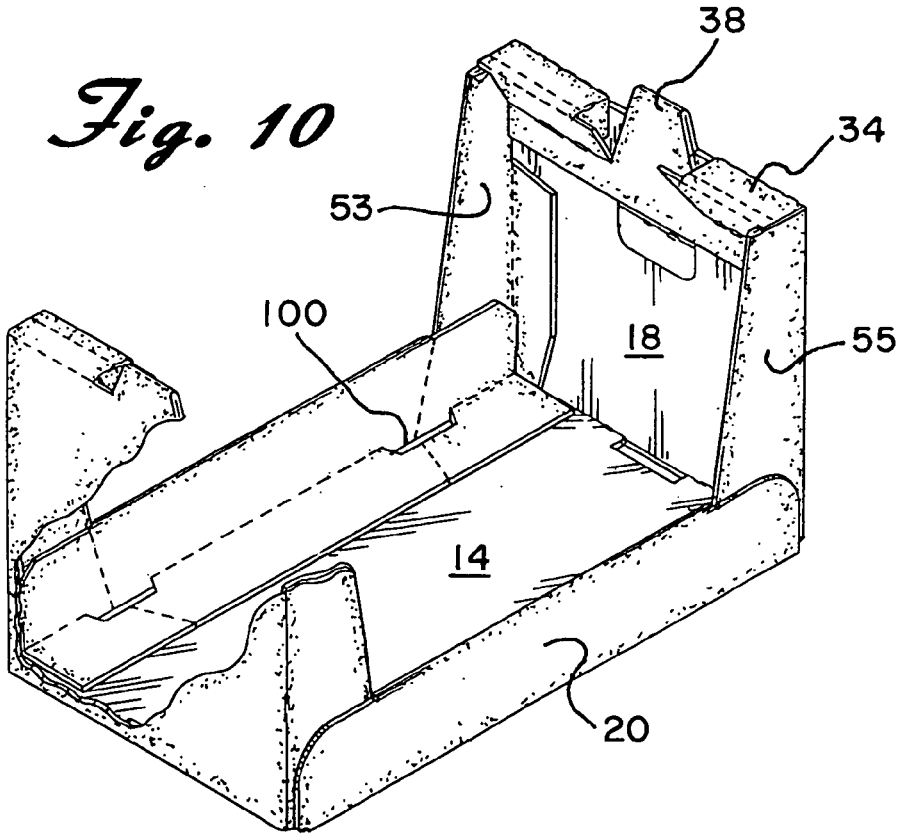
FIG. 10 is a perspective view similar to FIG. 9 showing the final steps in forming the front and rear partial walls.

As shown most clearly in FIG. 9, once the panel portions 84 and 86 are folded into the interior of the container, panels 84 and 86 are forced into right angles with respect to each other about fold line 98 as shown in FIG. 10. In this position, panel portion 88 forms the outer part of the partial front wall 20 while panel portion 86 forms the inner surface of the partial front wall 20 and panel portion 84 lies on the lower wall 14. The panel portions 84, 86 and 88 are held in place by forcing the projections 100 secured to the panel portion 86 at the junction between panels 84 and 86 into slotted openings 102 in the bottom wall 14. Similarly, tabs 104 at the ends of the panel portion 86 are forced into place into the slots 106 formed in the corners. It can be seen, therefore, the extreme edges of the front wall portion 20 adjacent the corners are comprised of five plies of material all of which extend to the bottom wall 14. Furthermore, as one moves inwardly from the corner, the front wall 20 is comprised of four plies of material including the foot 56.

After the side wall 16 and 18 are erected and the front and rear wall 20 and 22 are formed, the shoulders and positioning tabs are formed as shown most clearly in FIGS. 5 and 6. This is accomplished by folding panel portion 108 inwardly about fold line 110. Simultaneously, panel portion 112 begins to fold inwardly about fold line 114 and the panel portions 112 and 116 form the shoulder 34. Once the shoulder 34 is formed, the tabs 116 and 118 at the ends thereof are pushed downwardly as shown in FIG. 6 to prevent the shoulder from flexing upwardly and to maintain the same in its horizontal orientation. As should be readily apparent, the positioning tabs 38, however, remain extending upwardly as the two layers or thickness of material forming the tabs are glued together. And since the tabs 38 are formed by folding about the fold line 68, the top horizontal fold line forming the distal end of the tab (and the uppermost top of the container) lies slightly inwardly of the outer plane of the side wall. This aids in guiding the tabs into the slots in the bottom wall of the container stacked thereon.

The present invention may be embodied in other specific forms without departing from the spirit or essential attributes thereof and accordingly, reference should be made to the appended claims rather than to the foregoing specification as indicating the scope of the invention.

What is claimed is:

1. A stackable display container constructed of a single piece of sheet material folded to form said container comprising:

a substantially horizontal bottom wall having a left edge, a right edge, a front edge and a rear edge;

at least partial left and right side walls extending substantially vertically upwardly from said left and right side edges, respectively;

at least partial front and back walls extending substantially vertically upwardly from said front and rear edges, respectively, said front wall including an outer front wall segment and an inner front wall segment substantially coextensive therewith;

left and right front corner columns, each corner column being formed of a segment of said sheet material folded to form a foot, a side corner wall and a front corner wall, each side corner wall coinciding essentially with its respective container side wall and the front corner walls lying in essentially the same plane as said front wall, each of said corner walls extending to said bottom wall;

said inner and outer front wall segments being joined together along a substantially horizontally extending fold line with said fold line lying over the tops of said feet, said inner and outer front wall segments extending substantially to the left and right side walls, said outer front wall segment covering the front surface of the lower portion of said front corner walls and said inner front wall segment substantially covering the inner surface of the lower portion of said front corner walls;

said inner wall segment includes score lines that facilitate the flexing of the ends of said inner wall segment to allow them to pass around said front corner walls as said container is being assembled and said inner front wall segment including a flap extending perpendicularly therefrom which lies on said bottom wall, said flap including score lines that are continuations of said score lines formed in said inner front wall segment.

2. A stackable display container constructed of a single piece of sheet material folded to form said container comprising:

a substantially horizontal bottom wall having a left edge, a right edge, a front edge and a rear edge;

at least partial left and right side walls extending substantially vertically upwardly from said left and right side edges, respectively, each of said side walls including a substantially horizontally extending shoulder at the top thereof for supporting the bottom of a similarly constructed container stacked thereon, each shoulder being formed from an additional portion of said sheet material extending from the top of each side wall and folded inwardly and then downwardly, said side walls further including upwardly extending positioning tabs formed from said additional portion of said sheet material extending from the top of each side walls;

at least partial front and back walls extending substantially vertically upwardly from said front and rear edges, respectively;

left and right front corner columns, each corner column being formed of a segment of said sheet material folded to form a side corner wall and a front corner wall, each side corner wall coinciding essentially with its respective container side wall and the front corner walls lying in essentially the same plane as said front wall, each of said corner walls extending to said bottom wall.

3. The stackable display container as claimed in claim 2 wherein said positioning tabs are comprised of a double thickness of said sheet material folded over itself along a substantially horizontal fold line.

4. A stackable display container constructed of a single piece of sheet material folded to form said container comprising:

a substantially horizontal bottom wall having a left edge, a right edge, a front edge and a rear edge;

at least partial left and right side walls extending substantially vertically upwardly from said left and right side edges, respectively, each of said side walls including a substantially horizontally extending shoulder at the top thereof for supporting the bottom of a similarly constructed container stacked thereon and wherein the distal edge of said additional portion of said sheet material is glued to the inner surface of its respective side wall at a position above said bottom wall;

at least partial front and back walls extending substantially vertically upwardly from said front and rear edges, respectively;

left and right front corner columns, each corner column being formed of a segment of said sheet material folded to form a side corner wall and a front corner wall, each side corner wall coinciding essentially with its respective container side wall and the front corner walls lying in essentially the same plane as said front wall, each of said corner walls extending to said bottom wall.

5. A stackable display container constructed of a single piece of sheet material folded to form said container comprising:

a substantially horizontal bottom wall having a left edge, a right edge, a front edge and a rear edge;

at least partial left and right side walls extending substantially vertically upwardly from said left and right side edges, respectively, each of said side walls including a substantially horizontally extending shoulder at the top thereof for supporting the bottom of a similarly constructed container stacked thereon, each of said side walls further including a positioning tab extending upwardly therefrom to cooperate with the bottom of said similarly constructed container positioned thereon, said positioning tabs being formed from an additional portion of said sheet material extending from the top of each side wall;

at least partial front and back walls extending substantially vertically upwardly from said front and rear edges, respectively;

left and right front corner columns, each corner column being formed of a segment of said sheet material folded to form a side corner wall and a front corner wall, each side corner wall coinciding essentially with its respective container side wall and the front corner walls lying in essentially the same plane as said front wall, each of said corner walls extending to said bottom wall.

6. A stackable display container constructed of a single piece of sheet material folded to form said container comprising:

a substantially horizontal bottom wall having a left edge, a right edge, a front edge and a rear edge;

at least partial left and right side walls extending substantially vertically upwardly from said left and right side edges, respectively, each of said side walls including a substantially horizontally extending shoulder at the top thereof for supporting the bottom of a similarly constructed container stacked thereon, each shoulder being formed from an additional portion of said sheet material extending from the top of each side wall and folded inwardly and then downwardly, the distal edge of said additional portion of said sheet material being glued to the inner surface of its respective side wall at a position above said bottom wall;

at least partial front and back walls extending substantially vertically upwardly from said front and rear edges, respectively;

left and right front corner columns, each corner column being formed of a segment of said sheet material folded to form a side corner wall and a front corner wall, each side corner wall coinciding essentially with its respective container side wall and the front corner walls lying in essentially the same plane as said front wall, each of said corner walls extending to said bottom wall.

* * * * *